United States Patent [19]

Mills et al.

[11] Patent Number: 4,607,680

[45] **Date of Patent: * Aug. 26, 1986**

[54] METHOD AND MOULD FOR CASTING METAL ARTICLES

[75] Inventors: David Mills; Alan D. Kington; Rodney J. Close, all of Bristol, England

[73] Assignee: Rolls-Royce Limited, London, England

[ * ] Notice: The portion of the term of this patent subsequent to May 14, 2002 has been disclaimed.

[21] Appl. No.: 706,599

[22] Filed: Feb. 28, 1985

Related U.S. Application Data

[62] Division of Ser. No. 365,047, Apr. 2, 1982, Pat. No. 4,516,621.

[30] Foreign Application Priority Data

Apr. 13, 1981 [GB] United Kingdom ..... 8111519

[51] Int. Cl.[4] ..... B22C 9/08; B22D 23/00

[52] U.S. Cl. ..... 164/134; 164/129; 164/137; 164/339; 164/358; 164/361; 164/363; 249/109; 249/110

[58] Field of Search ..... 164/133, 134, 358, 129, 164/137, 339, 361, 363; 249/109, 110

[56] References Cited

U.S. PATENT DOCUMENTS

| | | | |
|---|---|---|---|
| 539,209 | 5/1895 | Adams | 164/350 |
| 1,100,831 | 6/1914 | Kline | 164/134 X |
| 1,653,232 | 12/1927 | Smith | 164/350 |
| 2,451,505 | 10/1948 | Myskowski et al. | 164/134 X |
| 2,806,268 | 9/1957 | Bilter | 164/350 |
| 3,815,661 | 6/1974 | Curran et al. | 164/358 X |
| 4,072,180 | 2/1978 | Hoult | 164/350 X |
| 4,133,371 | 1/1979 | Birch et al. | 164/363 X |

FOREIGN PATENT DOCUMENTS

| | | | |
|---|---|---|---|
| 1130326 | 9/1956 | France . . | |
| 46-25149 | 7/1971 | Japan | 164/358 |
| 408153 | 4/1934 | United Kingdom . | |
| 542576 | 1/1942 | United Kingdom . | |
| 546991 | 8/1942 | United Kingdom . | |
| 557204 | 11/1943 | United Kingdom . | |
| 656956 | 9/1951 | United Kingdom . | |
| 738783 | 10/1955 | United Kingdom . | |
| 810294 | 3/1959 | United Kingdom . | |
| 917990 | 2/1963 | United Kingdom . | |
| 1062093 | 3/1967 | United Kingdom . | |
| 2096502A | 10/1982 | United Kingdom . | |
| 737105 | 5/1980 | U.S.S.R. | 164/362 |

OTHER PUBLICATIONS

Swanson, D. C., "New Method of Filtering Molten Aluminum", In Foundry M & T, Jul. 1974, p. 94.

*Primary Examiner*—Nicholas P. Godici
*Assistant Examiner*—J. Reed Batten, Jr.
*Attorney, Agent, or Firm*—Parkhurst & Oliff

[57] ABSTRACT

A method for moulding multiple castings in which each mould is fed from a source of molten metal through a thin slit the width of which lies in the range 1.25 mm down to 0.25 mm. The cast articles can easily be removed from the runner and riser system after casting without a machining operation so that the casting moulds can be packed closer together and more castings can be produced from each mould assembly. The thin slit also acts as a filter. A particular mould assembly seen in FIG. 2 is cylindrical and comprises a plurality of wedge-shaped mould segments 2 having mould cavities 4 in abutting faces. A central runner passage 6 is formed when the mould segments are assembled and the metal flows into the mould cavities through narrow slits 10 in one edge of each mould. After casting and removal of the mould the narrow flashing formed in the slits can easily be broken to remove the cast articles from the metal formed in the central runner passage.

6 Claims, 3 Drawing Figures

METHOD AND MOULD FOR CASTING METAL ARTICLES

This is a division of application Ser. No. 365,047 filed Apr. 2, 1982 and now U.S. Pat. No. 4,516,621 issued May 14, 1985.

The present invention relates to a method of casting metal articles and a mould assembly for use in carrying out the method.

Two problems arise in casting components, such as gas turbine engine blades, in the so-called superalloy materials, i.e., nickel or cobalt based alloys.

One relates to adequate filtration of the molten metal to prevent inclusions in the casting, because the fine filters required for such components can block prematurely and cut off the metal feed to the casting.

The other problem relates to multiple mould assemblies for production of a plurality of castings simultaneously. In such assemblies the cast components have to be removed from the runner system by a machining process, which means that the individual castings need to be separated by a greater distance than would otherwise be the case in order to prevent the machine tool from cutting the castings.

These problems are both overcome by the casting method and mould assembly of the invention as claimed wherein the metal is run into the mould from a runner passage through a narrow slit or slits, the width of which lies in the range 1.25 mm to 0.25 mm (0.050 in to 0.010 in).

Although it is known to run metal into moulds through slits, it has not, as fas as we are aware, been known to use slits of such small width. The advantages provided by this unique approach are that the slit acts as a natural filter which, because of its length will not easily be blocked by inclusions, and, the thin connecting link produced between the casting and the runner system formed by metal solidifying in the slit, is relative easily broken without the need for a machining operation. Thus the moulds can be packed together more tightly and the productivity of the method increased.

It has been found during our experimental work that the liquid metal being poured will run quite satisfactorily through much narrower spaces than hitherto thought possible and this has enabled the mould assembly to be re-designed to reduce the problems outlined above.

We have found that provided that there is enough heat capacity in the runner system, the metal in the narrow slit will remain molten so that the casting cavity of the mould can be fed directly from the runner system through the slit or slits. In such cases a slit is preferably provided which runs the whole length of the mould, or alternately two slits are provided, one at each end of the mould.

However, in cases where feeding of the casting cavity through the slit may provide difficulty, the casting cavity within the mould may be enlarged adjacent the slit to provide a feed chamber between the slit and the actual article cavity of the mould. Under these circumstances, it will not matter if the metal in the slit freezes prematurely because the feed chamber will supply any metal required to take up shrinkage as the metal in the article cavity freezes.

The invention is particularly applicable to an assembly of moulds of the type described in UK Pat. No. 1,584,367, in which a plurality of mould segments are held together in an assembly with confronting faces of the segments, which together define a mould cavity, in registry. In a preferred form such a mould assembly is cylindrical and the mould segments are wedge-shaped.

The invention will now be more particularly described, by way of example only, and with reference to the accompanying drawings, in which.

Figure 1:
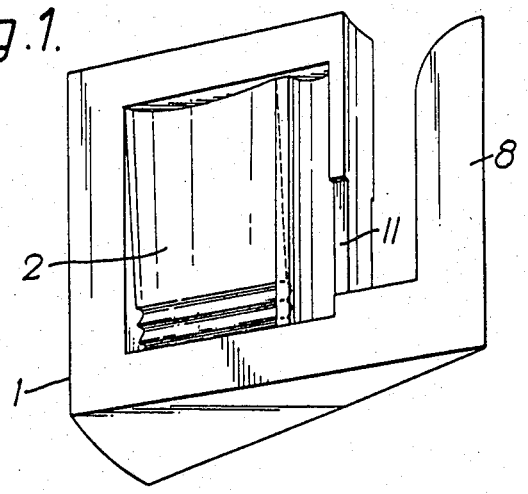
FIG. 1 is a pictorial view of a mould segment of the present invention.
Figure 2:
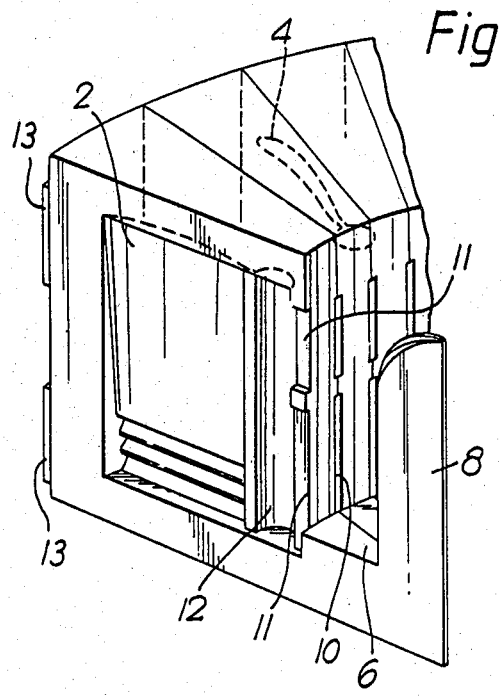
FIG. 2 is an illustration of a part of a mould assembly formed by a plurality of the mould segments of FIG. 1, and, FIG. 3 is a plan view of an alternative embodiment of an assembly of castings made from the mould assembly of FIG. 2.

Referring now to the drawings each of the mould segments 1 of FIG. 1 has formed in one side-face thereof an article cavity 2 which forms part of a mould cavity 4 which is produced when two mould segments are put together with complementary cavity parts in registry. The mould segment is wedge-shaped so that when sufficient of them are put together in an assembly they form a cylindrical array. The wedge-shaped segments are truncated so that, in the assembly, a central, circular runner passage 6 is formed. The runner passage 6 communicates with the mould cavity through slits 10 which are arranged to be small enough in width to filter any inclusions of a given pre-determined size from the metal entering the casting cavity. The slits are formed by cut-outs 11 in one or both of the abutting faces of the mould segments.

The particular assembly shown in the drawings is for casting of turbine blades for a gas turbine engine for which purpose one of the nickel or cobalt based superalloys is to be used, e.g. that sold under the Trade Name of IN 100 sold by the International Nickel Company. Since such alloys have a high shrinkage rate the mould cavity 4 is provided with a feed chamber 12 into which the metal flows from the runner passage 6 via the slits 10. By arranging the dimensions of the feed chamber relative to the article cavity such that the metal in the feed chamber is the last to solidify, adequate feeding of the article cavity 2 can be ensured even if the metal in the slit 10 freezes prematurely.

In this assembly, therefore, the heat capacity of the runner passage is not so important and a minimum amount of metal can be used. To this end each mould segment is provided with a pillar 8 extending from its main body to fill part of the runner passage, and in the assembly, all of the pillars abut to form a dome over which the liquid flows during pouring.

We have found that the nickel based superalloys required for gas turbine engine blades will run through slits down to 0.23 mm (0.010 in) in width, which gives very effective filtering, and the flashing thus produced is broken away from the remainder of the runner system quite easily. A reasonable maximum width for the slot is of the order of 1.00 mm to 1.25 mm (0.050 in) beyond which the material is difficult to break off and the potential inclusion size passing into the casting is unacceptable.

Since the moulds are porous, air can escape from the mould cavities during pouring and thus the above-described method enables the elimination of the runner and riser passages of a conventional bottom filling system.

During pouring the array of moulds must be tightly clamped together, and a preferred means for doing this is with one or more bands 13 of a refractory tape sold under the Trade Name REFRASIL by the Chemical and Insulating Company Limited of Darlington, as described in co-pending UK patent application No. 8111223 entitled "Refractory Articles and a Method for the Manufacture Thereof".

Figure 3:
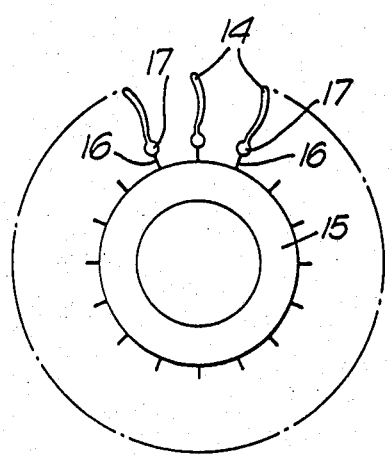

FIG. 3 shows the configuration of the cast metal after the mould has been removed. The cast blades 14 from the cavity 4 are connected to the cylinder 15 of metal from the runner passage 6 by the flashing 16 from slits 10 and the metal 17 from the feed chamber 12.

Because the flashing is very weak and the cast blades can be broken away from the remainder of the casting quite easily, no allowance has to be made for a machine cutter to be inserted between the cast blades to cut them off. Thus each mould assembly can be designed to produce more articles which are more closely packed together. Once the articles have been removed from the cast assembly, the metal 17 from the feed chamber 12 can easily be machined away. A further advantage of the process is that the slit 10 can be arranged to run the whole length of the casting cavity so that hot metal is fed into each mould over its whole length, giving a much more even heat distribution along the length of the mould.

It is possible to arrange the feeding of each mould cavity directly from the slit 10 without the use of a feed chamber 12. For this method to be successful however, it is essential to avoid premature solidification of the metal in the slit, so that care has to be taken to ensure that there will be enough molten metal in the runner passage to keep that in the slit from freezing. The casting cavity will thus be fed from the runner passage directly. It will also be necessary to ensure that the depth of the slit 10 (i.e. the distance between the runner passage 6 and the casting cavity) is kept so short that premature solidification of metal does not occur in the slit. It is beneficial using this arrangement that the slit should extend the whole length of the mould cavity, or at least that slits should be provided at the top and bottom of the mould to ensure that liquid metal is fed to the mould at the top to fill any shrinkage volume as the metal solidifies.

Clearly the method and mould are applicable to casting many articles other than the turbine blades described above, and the method is applicable to moulds and mould assemblies other than that described above.

The mould segments may be manufactured by any convenient method, for example, by injection moulding, but as an alternative to the mould segments described above the moulds may be formed as individual components with their internal cavities, and the slits 10 formed, for example, by the lost wax process.

We claim:

1. A method of casting comprising the steps of:

making a mould having a mould cavity therein and including at least one elongated slit integrally formed in said mould, wherein the width of said at least one slit lies in the range 1.25 mm to 0.25 mm and said at least one slit communicates between the mould cavity and the exterior of the mould, providing a runner passage connected to the mould and communicating with the at least one slit, and providing a supplu of liquid metal into the runner passage whereby the liquid metal enters the mould cavity only through said at least on slit.

2. a method as claimed in claim 1 and in which the mould cavity of the mould is shaped to include both an article cavity and a feeding chamber disposed between the article cavity and the at least one slit and wherein the liquid metal is supplied through the at least one slit to the feeding chamber and then to the article cavity.

3. A method as claimed in claim 1, wherein the at least one slit is formed in a wall defining said runner passage.

4. The method according to claim 1, wherein said liquid metal is selected from the group consisting of nickel- and cobalt-based super alloys.

5. A moulding apparatus comprising:

a mould having a mould cavity therein and further having at least one elongated slit integrally formed therein the width of which lies in the range 1.25 mm to 0.25 mm, said at least one elongated slit communicating between said mould cavity and an exterior of said mould;

a runner passage connected to the mould and communicating with said at least one slit for providing a supply of liquid metal to the mould cavity through said at least one slit.

6. The moulding apparatus as claimed in claim 5, in which said mould cavity comprises:

an article cavity; and a feeding chamber disposed between said article cavity and said at least one slit.

* * * * *